United States Patent [19]

Mashimo et al.

[11] Patent Number: 5,032,480

[45] Date of Patent: Jul. 16, 1991

[54] MULTILAYER ELECTROPHOTOGRAPHIC PHOTORECEPTOR

[75] Inventors: Kiyokazu Mashimo; Fumio Ojima; Masahiko Hozumi; Taketoshi Hoshizaki; Kazuyuki Nakamura, all of Kanagawa, Japan

[73] Assignee: Fuji Xerox Co., Ltd., Tokyo, Japan

[21] Appl. No.: 290,536

[22] Filed: Dec. 27, 1988

[30] Foreign Application Priority Data

Jan. 7, 1988 [JP] Japan ..... 63-000723

[51] Int. Cl.[5] ..... G03G 5/06; G03G 5/087; G03G 5/047

[52] U.S. Cl. ..... 430/58; 430/78; 430/84; 430/85; 430/86

[58] Field of Search ..... 430/58, 78, 84, 85, 430/86

[56] References Cited

U.S. PATENT DOCUMENTS 3,816,118 6/1974 Byrne ..... 430/78 X
3,992,205 11/1976 Wiedemann ..... 430/78 X
4,755,443 7/1988 Suzuki et al. ..... 430/78 X

*Primary Examiner*—Roland Martin
*Attorney, Agent, or Firm*—Finnegan, Henderson, Farabow, Garrett and Dunner

[57] ABSTRACT

An electrophotographic photoreceptor is disclosed, which comprises an electrically conductive substrate having thereon a photosensitive layer comprising a resin binder in which the following two kinds of charge generating materials are dispersed: (i) selenium or an alloy of selenium and (ii) a phthalocyanine derivative represented by the formula:

(I)

wherein M represents AlCl, Mg, VO, InCl or $H_2$. The electrophotographic photoreceptor exhibits a broad spectral sensitivity extending from the visible to the infrared regions of the spectrum and, therefore, can be suited for printers which utilize such light sources as semiconductor lasers, light emitting diodes, etc.

9 Claims, 2 Drawing Sheets

MULTILAYER ELECTROPHOTOGRAPHIC PHOTORECEPTOR

FIELD OF THE INVENTION

The present invention relates to an electrophotographic photoreceptor. More specifically, it relates to an electrophotographic photoreceptor which preferably comprises an electrically conductive substrate having layered thereon a charge generating layer and a charge transporting layer.

BACKGROUND OF THE INVENTION

Electrophotographic photoreceptors of the function separation type have been proposed which are provided with a charge generating layer and a charge transporting layer. In recent years, such electrophotographic photoreceptors have been used not only in electrophotographic copying machines, but also printers utilizing such light sources as semiconductor lasers, light emitting diodes, etc. It is therefore strongly desired to develop a charge generating material having broad spectral sensitivity extending from the visible to the infrared region of the spectrum (400 to 800 nm).

Various charge generating materials have hitherto been proposed. However, there is no single charge generating material that satisfies the above requirement. JP-B-59-32788 (the term "JP-B" as used herein means an "examined Japanese patent publication") proposes to use in the charge generating layer at least two pigment or dyes having different spectral sensitivity characteristics (phthalocyanine dyes are used for longer wavelength regions).

However, electrophotographic photoreceptors utilizing two or more pigments or dyes having different spectral sensitivity characteristics suffer from the disadvantage that their sensitivity markedly drops locally, as shown, e.g., in FIG. 2 which depicts spectral sensitivity curves (the ordinate axis: sensitivity 1/E ½) B: N,N'-dimethylperylene-3,4,9,10-tetracarboxylic acid diimide, C: metal-free phthalocyanine, and A: wherein B and C are used in combination at a ratio (B/C) of 97/3 (an example shown in JP-B-59-32788). The figure indicates that the combined use of two pigments fails to provide a sufficient overall sensitivity because of the significant local decrease in sensitivity. In addition, it also suffers from the disadvantage that electrophotographic characteristics such as electrification property and dark decay, also change to a considerable extent.

SUMMARY OF THE INVNETION

A object of the present invention is to provide an electrophotographic photoreceptor which not only possesses a broad spectral sensitivity extending from the visible to the infrared region of the spectrum, but also exhibits excellent electrophotographic properties.

The above and other objects of the present invention are achieved by an electrophotographic photoreceptor which comprises an electrically conductive substrate having thereon a photosensitive layer comprising a resin binder in which the following two charge generating materials are dispersed: (i) selenium or an alloy of selenium and (ii) a phthalocyanine derivative represented by formula (I):

(I)

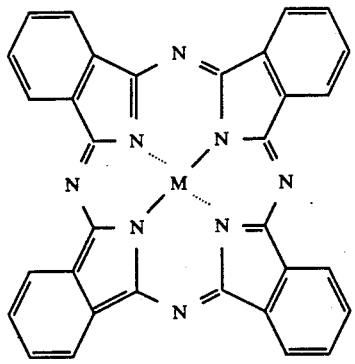

wherein M represents AlCl, Mg, VO, InCl or $H_2$.

Additional objects and advantages of the invention will be set forth in the description which follows, and in part will be apparent from the description, or may be learned by practice of the invention. The objects and advantages of the present invention may be realized and obtained by means of the instrumentalities and combinations particularly pointed out in the appended claims.

To achieve the foregoing objectives, the present invention provides an electrophotographic photoreceptor which comprises an electrically conductive substrate having thereon a photosensitive layer comprising a resin binder in which the following two charge generating materials are dispersed: (i) selenium or an alloy of selenium and (ii) a phthalocyanine derivative represented by the following formula (I):

(I)

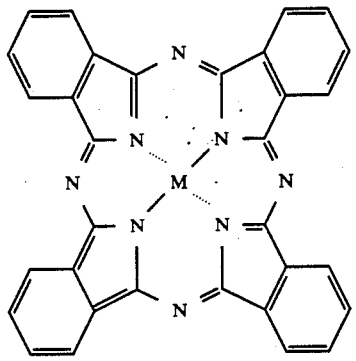

BRIEF DESCRIPTION OF THE DRAWINGS

The accompanying drawings, which are incorporated in and constitute a part of the specification, illustrate a presently preferred embodiment of the invention and, together with the general description given above and the detailed preferred embodiment given below, serve to explain the principles of the invention.

DETAILED DESCRIPTION OF THE INVENTION

Figure 1:
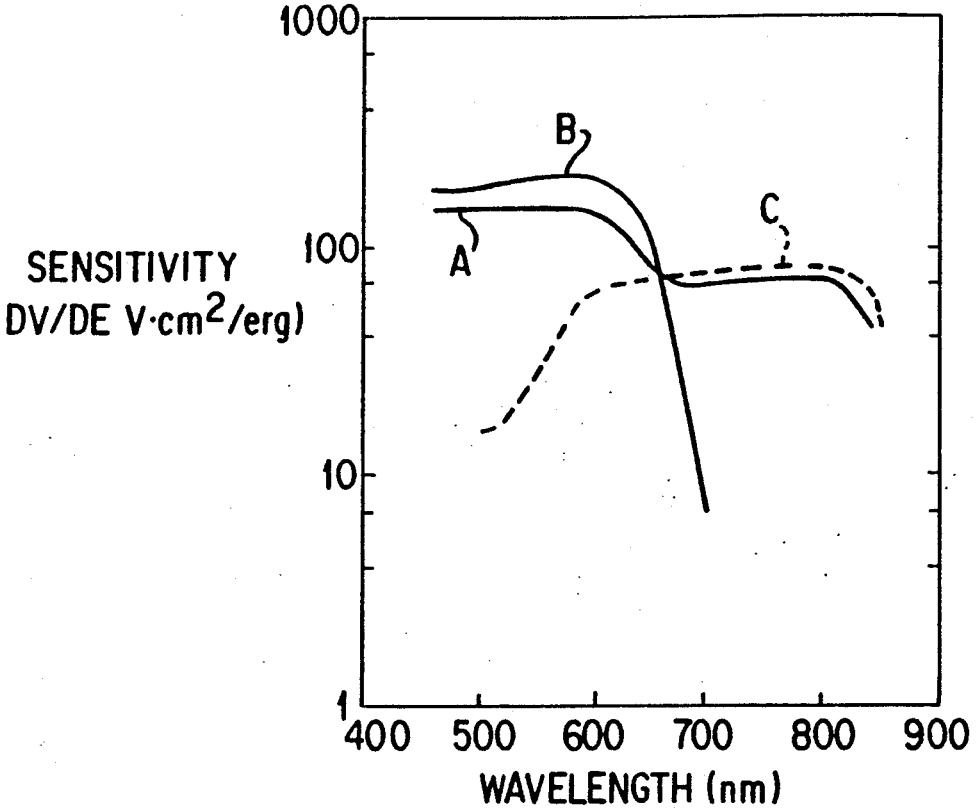
FIG. 1 is a graph showing spectral sensitivity characteristics of an electrophotographic photoreceptor incorporating the teachings of the present invention. Sensitivity DV/DE (v.cm²/erg) is plotted on the ordinate, wavelength (nm) on the abscissa.
Figure 2:
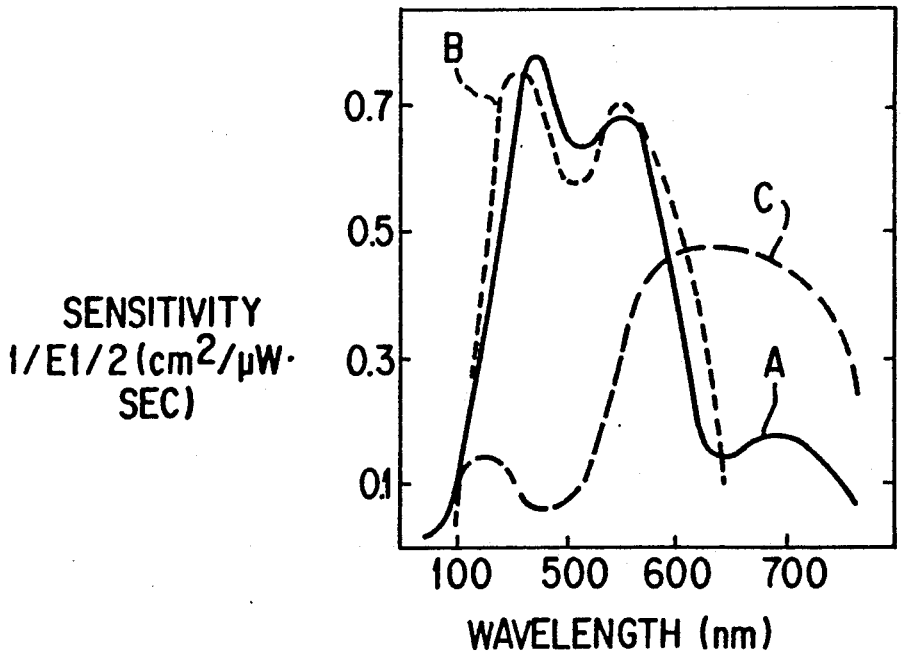
FIG. 2 is a graph showing spectral sensitivity characteristics of an electrophotographic photoreceptor according to the teachings of the prior art wherein curve B represents N,N'-dimethylperylene-3,4,5,10-tetracarboxylic acid diimide, curve C represents metalfree phthalocyanine, and curve A represents the combination of curves B and C in a ratio (B/C) of 97/3, and sensitivity $1/E.\frac{1}{2}$ ($cm^2/\mu W.sec$) is plotted on the ordinate.
Figure 3:
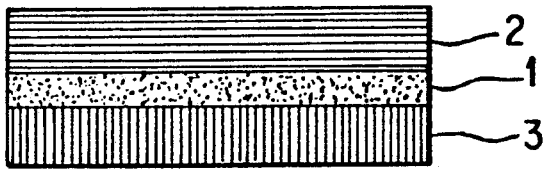
FIGS. 3 to 6 are schematic cross sectional views of embodiments of electrophotographic photoreceptors according to the present invention.
Figure 4:
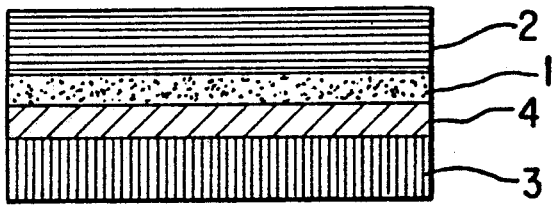
Figure 5:
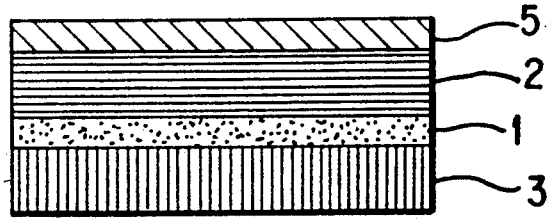
Figure 6:
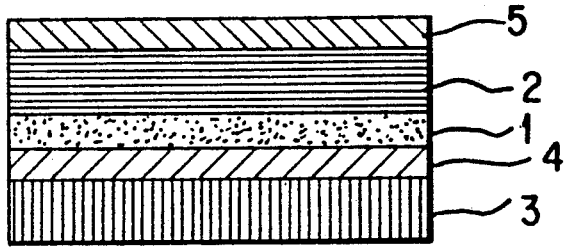

Reference will now be made in detail to the presently preferred embodiments of the invention as illustrated in the accompanying drawings.

In the electrically photographic photoreceptor of the present invention, a photosensitive layer is formed on a electrically conductive substrate. The photosensitive layer can be of a single layer structure which contains both a charge generating material and a charge transporting material. It is preferred that the photosensitive layer be of a layered structure consisting of a charge generating layer and a charge transporting layer.

In FIGS. 3 to 6 are shown schematic cross sectional views illustrating embodiments of electrophotographic photoreceptors according to the present invention. In the embodiment shown in FIG. 3, a charge generating layer 1 and a charge transporting layer 2 are formed in this order on an electrically conductive substrate 3. In the embodiment shown in FIG. 4, an undercoating layer 4 is formed between an electrically conductive substrate 3 and a charge generating layer 1. In the embodiment shown in FIG. 5, a protective layer 5 is formed on the surface of a charge transporting layer 2. In the embodiment shown in FIG. 6, an undercoating layer 4 is formed between an electrically conductive substrate 3 and a charge generating layer 1, and a protective layer 5 is formed on a charge transporting layer 2.

In the electrophotographic photoreceptor of the present invention, any known electrically conductive substrate can be used, including drums and sheets of metals such as aluminum, copper, iron, zinc and nickel, as well as drums, sheets and plates of paper, plastics or glass having a conductive layer formed thereon, e.g., by depositing a metal, such as aluminum, copper, gold, silver, platinum, palladium, titanium, nickel-chromium, stainless steel, copper-indium, etc., or a conductive metal compound, such as indium oxide, tin oxide, etc.; by laminating a metal foil; or by coating a dispersion of a resin binder containing conductive particles, such as carbon black, powders of indium oxide, tin oxide or antimony oxide, and powders of metals. The conductive materials to be used in the present invention are not limited to these.

Where desired, the surface of the electrically conductive substrate can be subjected to various treatments, for example, surface oxidation, chemical treatment or coloring, if such treatment does not adversely affect the quality of images.

An undercoating layer can be formed between the electrically conductive substrate and a charge generating layer. At the time when the electrophotographic photoreceptor having a layered structure is charged, the undercoating layer hinders electric charge from being injected from the electrically conductive substrate into the photosensitive layer. At the same time, the undercoating layer functions as an adhesive layer for securely retaining the photosensitive layer on the electrically conductive substrate in an integrated manner and, in some cases, performs the function of preventing the reflection of light on the surface of the electrically conductive substrate.

In the undercoating layer, known resin binders can be used, including, e.g., polyethylenes, polypropylenes, polyacrylates, polymethacrylates, polyamides, polyvinyl chlorides, polyvinyl acetates, phenolic resins, polycarbonates, polyurethanes, polyimides, polyvinylidene chlorides, polyvinyl acetals, vinyl chloride-vinyl acetate copolymers, polyvinyl alcohols, water-soluble polyesters, nitrocelluloses, caseins, gelatin, and the like. Among these, polyamides are preferably used in the present invention.

The thickness of the undercoating layer is preferably from 0.01 to 10 $\mu$m, and more preferably from 0.05 to 2 $\mu$m.

In the present invention, both (i) selenium or an alloy of selenium and (ii) a phthalocyanine derivative are used as charge generating materials in the photosensitive layer or in the charge generating layer. Examples of selenium or selenium alloys usable in the present invention include amorphous selenium, trigonal selenium, selenium-tellurium alloys, selenium-tellerium-arsenic alloys, and mixtures of these. It is particularly preferred to use trigonal selenium. Examples of usable phthalocyanine derivatives include chloroaluminum phthalocyanine, magnesium phthalocyanine, chloroindium phthalocyanine, vanadyl phthalocyanine, metal-free phthalocyanine, etc. Among these, metal-free phthalocyanine is preferably used. Also, M is preferably $H_2$.

The ratio, based on volume, of selenium or selenium alloys to phthalocyanine derivatives to be used in the invention is preferably in the range of from 10/1 to 1/1, and more preferably from 9/1 to 7/3.

In cases where the electrophotographic photoreceptor of the invention is of a layered structure, any known resin binder can be used in the charge generating layer, including polystyrene resins, polyvinyl acetal resins, polyacrylate resins, methacrylate resins, vinyl acetate resins, polyester resins, polyacrylate resins, polycarbonate resins, phenol resins, etc. These resins can be used either individually or in the form of a mixture. With respect to the dispersibility of pigment particles, as well as electrical properties in electrophotography, it is preferred to use polyvinyl acetal resins, and more specifically, polyvinyl butyral resins, polyvinyl formal resins, partially acetallized polyvinyl butyral resins or mixtures of two or more of these resins.

The ratio, based on volume, of selenium or selenium alloys and phthalocyanine derivatives to the resin binder is preferably from 10/1 to 1/10, and more preferably from 5/1 to 1/5.

In order to disperse the above-described selenium or selenium alloys and phthalocyanine derivatives into a resin binder, any conventional method can be used, including the ball mill method, the attriter method, the sand mill method, and the like. It is possible to previously admix selenium or a selenium alloy and a phthalocyanine derivative and then subject the mixture to a dispersing treatment, or disperse the two components separately and then admix the two into one dispersion.

It can be effective to reduce the particle size of the charge generating materials (i.e., a phthalocyanine derivative, selenium and selenium alloy) to 5 $\mu$m or less, preferably 2 $\mu$m or less and more preferably 0.5 $\mu$m or less.

Upon the above dispersing treatment, there can be used ordinary organic solvents, such as methanol, ethanol, n-propanol, n-butanol, benzyl alcohol, methyl cellosolve, ethyl cellosolve, acetone, methyl ethyl ketone, cryclohexanone, methyl acetate, dioxane, tetrahydrofuran, methylene chloride, chloroform, etc. These solvents can be used either alone or in the form of a mixture of two or more of them.

In general, the thickness of the charge generating layer in the electrophotographic photoreceptor of the invention is preferably from 0.1 to 5 μm, and more preferably from 0.2 to 2.0 μm.

The charge transporting layer in the electrophotographic photoreceptor of the present invention comprises a resin binder containing a charge transporting material. Any known material can be used as a charge transporting material, including oxadiazole derivatives, such as 2,5-bis(p-diethylaminophenyl)-1,3,4-oxadiazole, etc.; pyrazoline derivatives, such as 1,3,5-triphenylpyrazoline, 1-[pyridyl-(2)]-3-(p-diethylaminostyryl)-5-(p-diethylaminophenyl) pyrazoline, etc.; aromatic tertiary amino compounds, such as triphenylamine, dibenzylaniline, etc.; aromatic tertiary diamino compounds, such as N,N'-diphenyl-N,N'-bis-(3-methylphenyl)-[1,1'-biphenyl]-4,4'-diamine, etc.; 1,2,4-triazine derivatives, such as 3-(4'-dimethylaminophenyl)-5,6-di-(4'-methoxyphenyl)-1,2,4-triazine, etc.; hydrazone derivatives, such as 4-diethylaminobenzaldehyde-1,1'-diphenylhydrazone, etc.; quinoline derivatives, such as 2-phenyl-4-styrylquinazoline, etc.; benzofuran derivatives, such as 6-hydroxy-2,3-di(p-methoxyphenyl)benzofuran, etc.; α-stylbene derivatives, such as p-(2,2-diphenylvinyl)-N,N-diphenylaniline, etc.; enamine derivatives, such as those described in Journal of Imaging Science, Vol. 29, Pages 7–10 (1985); poly-N-vinylcarbazoles and derivatives thereof, such as poly-N-ethylcarbazoles, etc.; and poly-γ-carbazolethylglutamate and derivatives thereof. It is also possible to use pyrene, polyvinyl pyrenes, polyvinyl anthracenes, polyvinylacridines, poly-9-biphenyl-anthracenes, pyreneformaldehyde resins, ethylcarbazole-formaldehyde resins, or the like. Charge transporting materials to be used in the invention are not limited to these, and they can be used either alone or in combination (i.e., admixture).

In the charge transporting layer, any known resin binders can be used, for example polycarbonate resins, polyester resins, polymethacrylate resins, polyacrylate resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazoles, and the like. These resin binders can be used individually, or two or more of them can be used in combination.

The ratio, based on weight, of the charge transporting materials and the resin binders incorporated into the layer is preferably from 10/1 to 1/5, and more preferably from 5/1 to 1/5. The thickness of the charge transporting layer is preferably from 5 to 50 μm, and more preferably from 10 to 30 μm.

One or more conventional organic solvents can be used in the formation of the charge transporting layer. Examples of usable organic solvents include aromatic hydrocarbons, such as benzene, toluene, xylene, chlorobenzene, etc.; ketones, such as acetone, 2-butanone, etc.; halogenated fatty hydrocarbons, such as methylene chloride, chloroform, ethylene chloride, etc.; and cyclic and straight chain ethers, such as tetrahydrofuran, ethyl ether, etc. These solvents can be used either alone or in the form of a mixture of more than one of them.

If desired, a protective layer can be formed on the charge transporting layer. Such a protective layer can prevent chemical deterioration of the charge transporting layer when the layered electrophotographic photoreceptor (i.e., the layered photosensitive layer) is charged. In addition, it also serves to improve the mechanical strength of the electrophotographic photoreceptor.

Such a protective layer can be formed from a resin binder containing an appropriate conductive material. Examples of usable conductive materials include metallocene compounds, such as N,N'-dimethylferrocene, etc.; aromatic compounds, such as N,N'-diphenyl-N,N'-bis(3-methylphenyl)-[1,1'-biphenyl]4,4'-diamine, etc.; and metal oxides, such as antimony oxide, tin oxide, titanium oxide, indium oxide and tin oxide-antimony oxide. Known resins can be used as a resin binder for the protective layer, including, e.g., polyamide resins, polyurethane resins, polyester resins, epoxide resins, polyketone resins, polycarbonate resins, polyvinylketone resins, and polyacrylamide resins.

The protective layer preferably has an electircal resistance of $1\times10^9$ to $1\times10^4$ Ω.cm. If its electrical resistance is greater than $1\times10^4$ Ω.cm, its residual voltage becomes undesirably high, and, hence, foggy images result. If the electrical resistance is less than $1\times10^9$ Ω.cm, blurred images having a deteriorated resolution will result. Additionally, the protective layer should be constituted such that it does not substantially impede the passage necessary for the image-wise exposure.

The thickness of the protective layer is preferably from 0.5 to 20 μm, and more preferably from 1 to 10 μm.

The above-mentioned layers constituting the electrophotographic photoreceptor of the present invention can be formed by any conventional coating method, including blade coating, wire bar coating, spray coating, dip-coating, bead coating, air knife coating and curtain coating.

The following examples further illustrate preferred embodiments of the present invention. The examples should in no way be considered limiting, but are merely illustrative of the various features of the present invention.

EXAMPLE 1

An electrophotographic photoreceptor composed of an electrically conductive substrate, a charge generating layer and a charge transporting layer was prepared in the following manner.

A mixture having the following composition:

| | |
|---|---|
| Trigonal selenium (manufactured by Xerox Corp.) | 7 g |
| Metal-free phthalocyanine of type X (manufactured by Xerox Corp.) | 1 g |
| Partially formallized polyvinyl butyral resin (BX-2, manufactured by Sekisui Chemical Co., Ltd.) | 2 g |
| n-Butyl alcohol | 30 g |

was placed in a ball mill pot and then subjected to milling for 60 hours, using SUS (stainless steel) balls having a diameter of ⅛ inch, and the milled product was diluted with an additional 30 g of n-butyl alcohol and stirred to obtain a dispersion for forming a charge generating layer. This dispersion was dip-coated onto an aluminum substrate to form a charge generating layer having a thickness (after being dried) of 0.4 μm.

A dispersion having the following composition:

| | |
|---|---|
| α-Stylbene compound | 10 g |
| 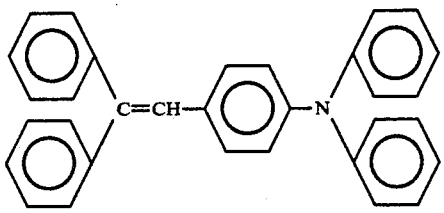 | |
| Polycarbonate resin (K-1300 manufactured by Teijin Kasei Co., Ltd.) | 10 g |
| Methylene chloride | 80 g |

was dip-coated onto the charge generating layer to form a charge transporting layer having a thickness (after being dried) of 20 μm.

The thus obtained electrophotographic photoreceptor (comprising an electrically conductive substrate—a charge generating layer—a charge transporting layer) was subjected to the following tests, using an electrostatic analyser (EPA-8100 manufactured by Kawaguchi Electric Co., Ltd.) in an atomosphere of ambient temperature and humidity conditions (25° C., 40% R.H.).

VDDP: Surface voltage after 1 second after the member is negatively charged by a corona discharge of −6.0 KV.

DV/DE: The decay rate of the surface voltage with a monochromatic light passed through a band pass filter of 550 or 800 nm.

RP: Surface voltage after 0.5 second after being exposed to 50 erg/cm$^2$ of white light.

There were obtained the following characteristic values:

VDDP: −805 V

DV/DE (550 nm): 152 V.cm$^2$/erg

DV/DE (800 nm): 68 V.cm$^2$/erg

RP: −40 V

In FIG. 1, there are shown spectral sensitivity characteristics in the region of from 450 to 800 nm. In the figure, "A", indicates a spectral sensitivity curve of the above-prepared electrophotographic photoreceptor; "B" indicates a spectral sensitivity curve of an electrophotographic photoreceptor in which trigonal selenium alone was used; and "C" indicates a spectral sensitivity curve of an electrophotographic photoreceptor in which metal-free phthalocyanine alone was employed. It is apparent from the results that the electrophotographic photoreceptor according to the present invention exhibits a broad sensitivity.

EXAMPLE 2

A mixture consisting of:

| | |
|---|---|
| Trigonal selenium (Manufactured by Xerox Corp.) | 6 g |
| Vanadyl phthaloxyanine (Manufactured by Xerox Corp.) | 2 g |
| Partially acetoacetallized polyvinyl butyral resin (BX-1 manufactured by Sekisui Chemical Co., Ltd.) | 2 g |

-continued

| | |
|---|---|
| n-Butyl alcohol | 40 g |

was placed in sand mill pot and then subjected to milling for 30 hours, using glass beads having a diameter of 1 mm, and the milled product was diluted with additional 20 g of n-butanol and stirred to obtain a dispersion for forming a charge generating layer. This dispersion was dip-coated onto an aluminum substrate to form a charge generating layer having a thickness (after being dried) of 0.3 μm.

A charge transporting layer having a thickness of 20 μm was formed thereon in the same manner as in Example 1, using a dispersion having the following composition:

| | |
|---|---|
| 4-Diethylaminobenzaldehyde-1,1'-diphenylhydrazone | 8 g |
| Polycarbonate resin (K-1300 manufactured by Teijin Chemical Co., Ltd.) | 12 g |
| Methylene chloride | 80 g |

The resulting electrophotographic photoreceptor was subjected to the same tests as in Example 1. The following results were obtained:

VDDP: −820 V

DV/DE (550 nm): 148 V cm$^2$/erg

DV/DE (800 nm): 62 V.cm$^2$/erg

It is apparent from the above results that the electrophotographic photoreceptor exhibits a broad spectral sensitivity.

Thus, the electrophotographic photoreceptor of the present invention in which selenium or an alloy of selenium and a phthalocyanine derivative represented by formula (I) are used in combination has a broad spectral sensitivity extending from the visible to the infrared region of the spectrum, and also has improved electrophotographic properties in the areas of electrification and dark decay.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor which comprises an electrically conductive substrate having thereon a photosensitive layer comprising a resin binder in which the following two charge generating materials are dispersed: (i) selenium or an alloy of selenium and (ii) a phthalocyanine derivative represented by formula (I):

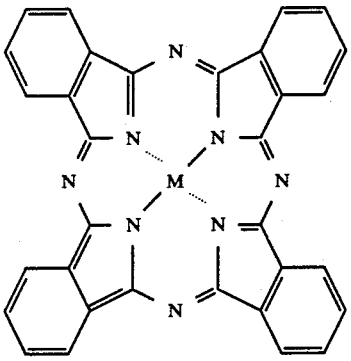

(I)

wherein M represents AlCl, Mg, VO, InCl or $H_2$ and wherein said photosensitive layer comprises a charge generating layer having a thickness of about 0.1 to about 5 μm and a charge transport layer having a thickness of about 5 to about 50 μm.

2. The electrophotosensitive photoreceptor as claimed in claim 1, wherein said selenium is a trigonal selenium.

3. The electrophotographic photoreceptor as claimed in claim 1, wherein said resin binder is a polyvinyl acetal resin.

4. The electrophotographic photoreceptor as claimed in claim 1, wherein in the phthalocyanine derivative of formula (I), M is $H_2$.

5. The electrophotographic photoreceptor as claimed in claim 1, wherein the particle size of the charge generating materials is reduced to 5 μm or less.

6. The electrophotographic photoreceptor as claimed in claim 1, wherein the ratio by volume of said selenium or selenium alloy to said phthalocyanine derivatives is from 10/1 to 1/1.

7. The electrophotographic photoreceptor as claimed in claim 1, wherein the ratio by volume of said selenium or selenium alloy to said phthalocyanine derivatives is from 9/1 to 7/3.

8. The electrophotographic photoreceptor as claimed in claim 1, wherein the ratio by volume of said selenium or selenium alloy and said phthalocyanine derivatives to said resin binder is from 10/1 to 1/10.

9. The electrophotographic photoreceptor as claimed in claim 1, wherein the ratio by volume of said selenium or selenium alloy and said phthalocyanine derivatives to said resin binder is from 5/1 to 1/5.

* * * * *